US006672183B2

(12) United States Patent
Johnson

(10) Patent No.: US 6,672,183 B2
(45) Date of Patent: Jan. 6, 2004

(54) QUICK RELEASE FOR USE WITH IMPACT WRENCH

(76) Inventor: Theodore L. Johnson, 309 Pine Forest Dr., Benton, AR (US) 72015

( * ) Notice: Subject to any disclaimer, the term of this patent is extended or adjusted under 35 U.S.C. 154(b) by 222 days.

(21) Appl. No.: 09/838,373

(22) Filed: Apr. 20, 2001

(65) Prior Publication Data

US 2002/0152848 A1 Oct. 24, 2002

(51) Int. Cl.[7] ..... B25B 21/00

(52) U.S. Cl. ..... 81/466; 81/177.85

(58) Field of Search ..... 81/177.85, 463–466; 403/325, 328

(56) References Cited

U.S. PATENT DOCUMENTS

| | | | | | |
|---|---|---|---|---|---|
| 5,050,467 | A | * | 9/1991 | Brown et al. | 81/466 |
| 5,390,571 | A | * | 2/1995 | Fox, III et al. | 81/177.85 |
| 5,862,723 | A | * | 1/1999 | Rowlands | 81/177.85 |
| 6,062,112 | A | * | 5/2000 | Bonniot | 81/177.85 |

* cited by examiner

*Primary Examiner*—D. S. Meislin
(74) *Attorney, Agent, or Firm*—Dennis B. Haase, Esq.

(57) ABSTRACT

A power tool in the nature of an impact tool in which a quick release mechanism for retention, and selective quick release of an accessory is provided. The quick release mechanism is actuated by a release pin disposed beneath the surface of the tool so as to be out of harms way, and actuation of the quick release mechanism is achieved by digital depression of the pin which in turn releases a latch engaging the accessory, permitting its removal from the tool.

3 Claims, 2 Drawing Sheets

QUICK RELEASE FOR USE WITH IMPACT WRENCH

The present invention relates generally to devices for the connection and quick release of tool accessories, such as sockets, and, more particularly, to apparatus for effecting the safe and rapid release of such tool accessories which are otherwise safely connected for use in an impact type power tool.

BACKGROUND OF THE INVENTION

1. Field of the Invention

With the increasing popularity of portable tools, and particularly such devices as drills, rotary wrenches and air driven devices, the tool industry has prioritized in the areas of safety and convenience. Whether it be in the home "do it yourselfer" or in heavy industry, emphasis has been placed on workplace safety and even more so if that place is the home.

Mindful of the adage that "time is money", emphasis has fallen similarly on convenience. Combining both objectives tends to increase the magnitude of design problems exponentially. The goal is to strike a balance between these objectives while optimizing each. The apparatus of the present invention is intended to meet this goal by providing, in the limited field of quick disconnect tool accessories for use with air driven impact tools, the ability to connect and release such accessories as sockets, for example, safely, and set with minimum effort, even in the most intensive setting.

2. Overview of the Prior Art

It is common, if not universal practice, to position and hold such tool accessories with a detent mechanism. Specifically, the accessory is pushed on to a mandrel, also referred to in the art as an anvil, typically having an accessory receiving section which is rectangular in cross section, in which is embedded a detent in the nature of a ball, or pin, which is spring biased outwardly, protruding from the mandrel. As the accessory is pushed over the detent, it moves inwardly against the spring bias, and then into an aperture in the accessory where it is held, hopefully, against inadvertent release.

Hsieh U.S. Pat. No. 6,006,632 is an example of a hand tool, as distinguished from a power tool, such as an impact tool, in which basic principals of a quick release accessory are disclosed.

Hsieh appears to have borrowed to a significant extent from Rose et al. U.S. Pat. No. 4,962,682, which teaches the removal of the spring bias in favor of a series of steel balls in a passage which engage the detent ball. The series of balls is capable of being manually released to permit the retraction of the detent and, thus, release of the accessory. A latch protrudes outwardly from the mandrel and is manually depressed to cause release of the pressure on the detent.

Inventors in the field, including Hsieh in his U.S. Pat. No. 6,003,414, expanded on his stop rod, as an alternative to a string of balls, and provided an alternative manual latch mechanism, again employing a control rod protruding outwardly from the mandrel where it can be manually depressed to effect release of a remote detent.

Other patents in the art seem to distinguish themselves from inventors such as Hsieh and Rose et al. by strategic placement of spring biasing of the mechanism. A thread common to each, however, is the use of a manually depressible release which protrudes above the mandrel where it can be manually manipulated to release pressure on the detent in order to remove the accessory from the mandrel.

SUMMARY OF THE INVENTION

The quick release mechanism of the present invention provides an element of safety, without sacrifice to convenience, by presenting to the consumer such a mechanism in which the latch remains beneath the outer circumference of the mandrel, even under the influence of significant centrifugal force, while permitting, at the appropriate time, digital release of the detent for removal of an accessory, such as a socket, safely and conveniently.

It is an objective, therefore, of the present invention, to provide a quick release mechanism of the type described, which is both safe and efficient for use with an air driven tool such as an impact tool.

It is another and further objective of the present invention to provide a quick release mechanism in which there are no protruding rotating elements which enhance the prospect of clothing being snagged, leading to more serious injury, or even knuckles being rapped and hands injured, as the mandrel is rotated at considerable speeds.

An objective, related to the foregoing, is to provide a fast and efficient quick release system capable of effective use in commercial environments and, in particular, where heavy loads and higher speeds are encountered on a daily basis.

It will be appreciated that other objects and advantages of the present invention will occur to those skilled in the art when the following Detailed Description of a Preferred Embodiment is read in conjunction with the accompanying sheets of drawings, wherein:

DESCRIPTION OF A PREFERRED EMBODIMENT

Figure 1:
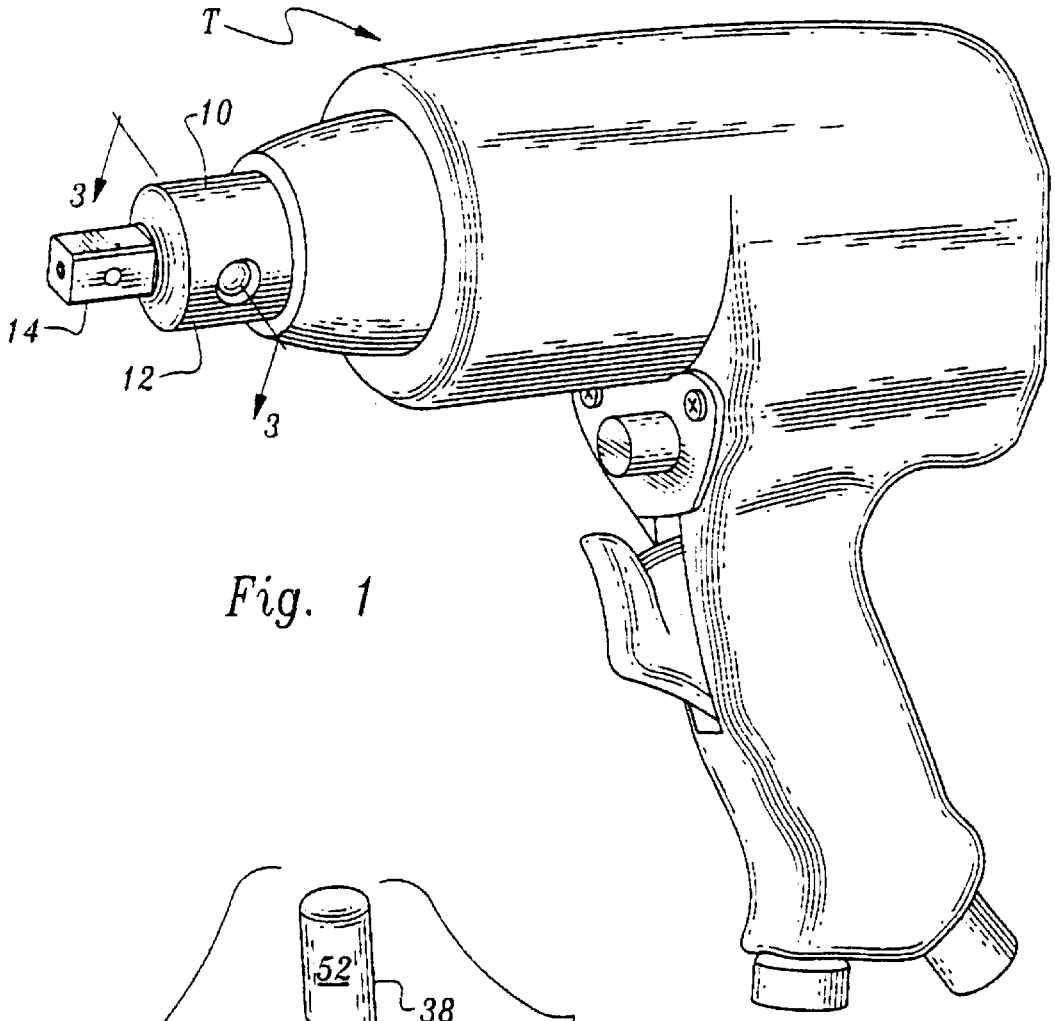
FIG. 1 is a pictorial representation of an impact wrench, shown in perspective, as illustrative of the type of tool to which the present invention has particular utility.

With reference now to the sheets of drawings, and initially to FIG. 1, an impact tool T is illustrated to depict the environment in which the quick release system of the present invention has particular utility.

The tool T is equipped with an anvil or mandrel 10, which is rotatably secured in the tool T. While not shown here, it is well understood that the tool T includes a motor and may use air under pressure as motive power, or in other applications, an electric motor may be used. Rotation of the motor is transmitted to the mandrel 10, perhaps through a simple geared transmission and/or a dog type clutch. Where a transmission is involved, it may be a step up or step down transmission, depending on whether torque or speed is the primary objective.

Figure 2:
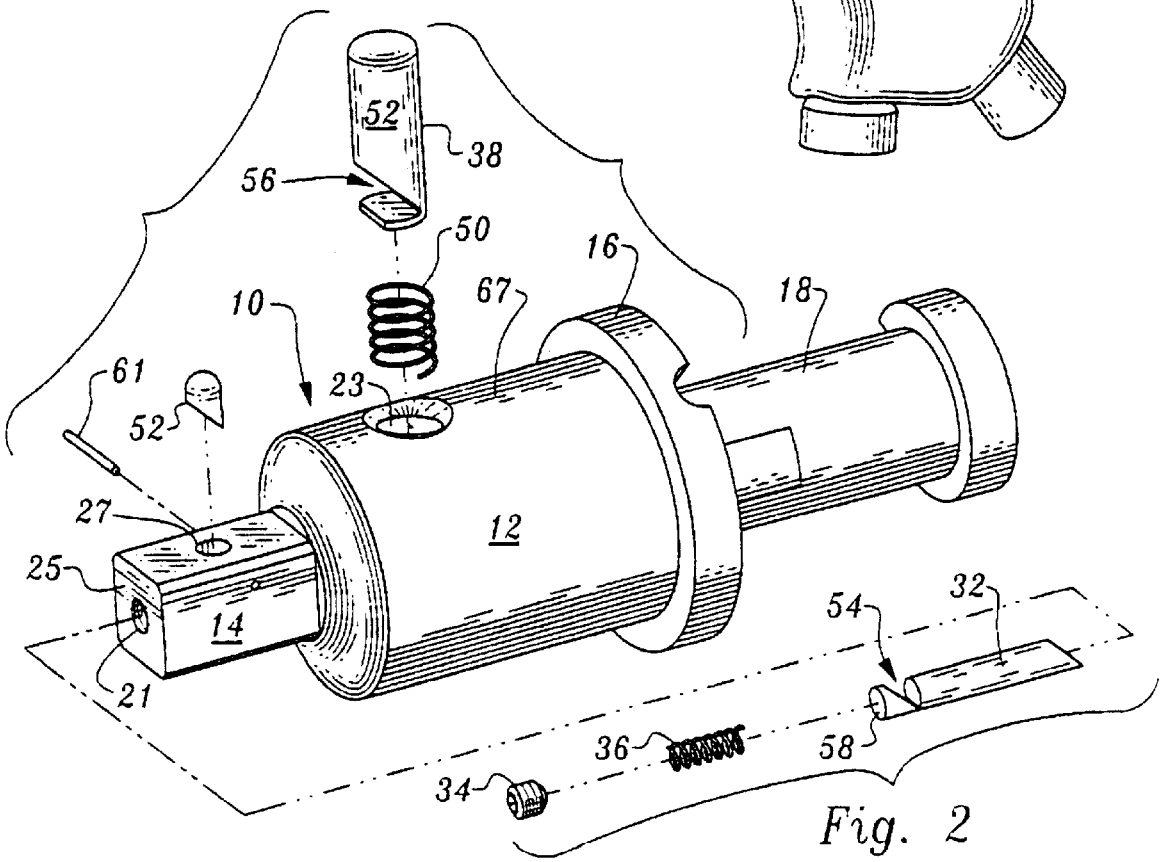
FIG. 2 is a perspective view of a mandrel, or anvil, as it is sometimes called, partially exploded to illustrate various elements of the operative mechanism.

With reference now primarily to FIG. 2, the anvil 10, constructed in accordance with the present invention, is shown in some detail. Specifically, a barrel 12 is formed, or otherwise fixed with an accessory receiving end member 14. The end member 14 is rectangularly shaped in the manner of the industry standard. A collar 16 permits the anvil 10 to be secured within the tool T, and the drive extension, sometimes referred to as a timing shaft 18, completes the anvil.

The structure of the anvil, or mandrel 10, as just described, is generally known in the industry, and details of that construction may vary among the various manufacturers of impact tools, without departure from the invention, which resides primarily in the quick release mechanism embodied therein.

Figure 3:
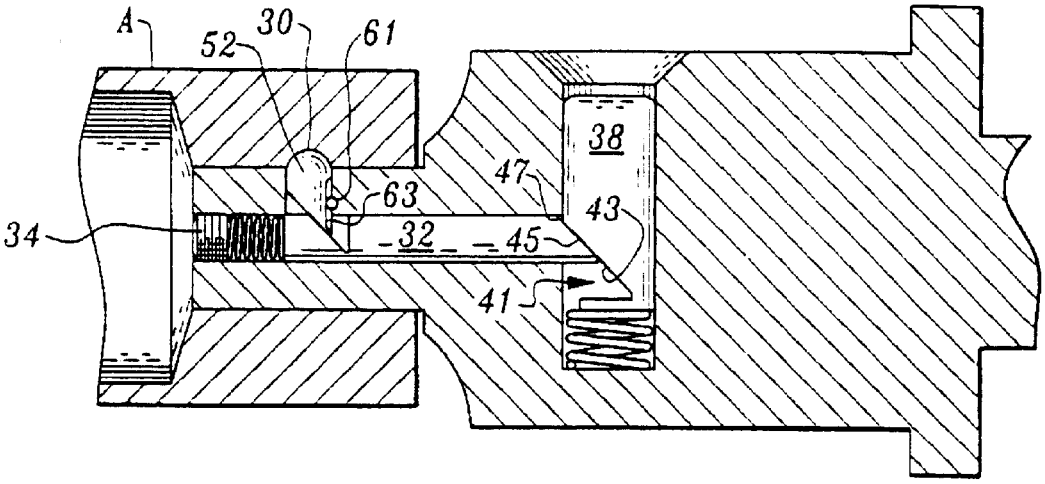
FIG. 3 is a sectional view of a portion of FIG. 1, taken along line 3—3, and showing the quick release mechanism of the present invention in locked position with a typical accessory, such as a socket having a shallow receptacle, secured in operative position on the mandrel, or anvil, of the tool.
Figure 4:
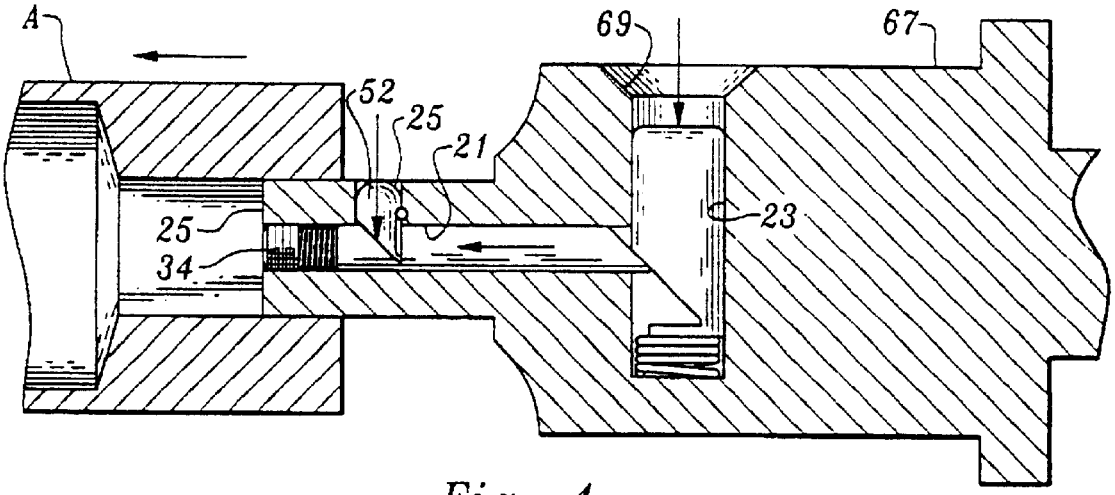
FIG. 4 is a view similar to that of FIG. 3, showing the quick release mechanism in its release mode, with the accessory being capable of removal.
Figure 5:
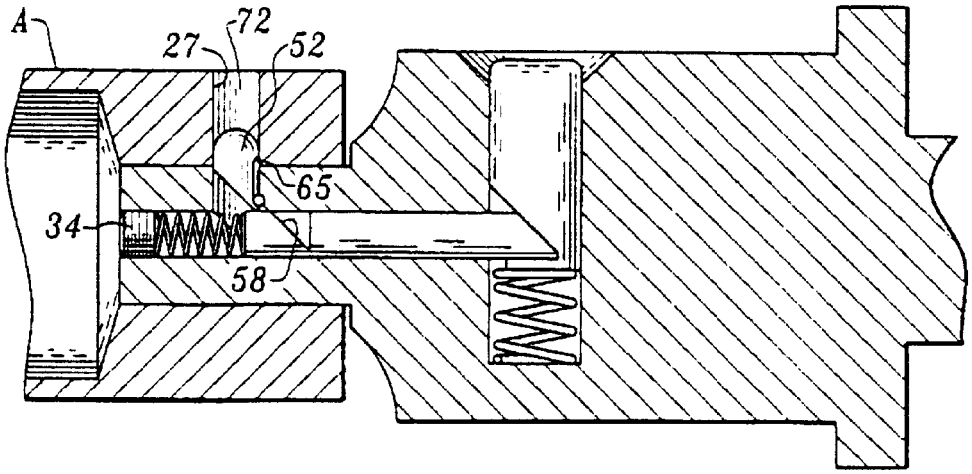
FIG. 5 is yet another view of the of the quick release mechanism in which that mechanism employs an elongated pin for use with accessories wherein a transverse passage passes to the outer circumference of the accessory.

Referring now, therefore, to FIGS. 3, 4 and 5, it will be seen that the anvil 10 is formed with an axial bore 21 which intersects a transverse bore 23. The transverse bore 23 opens through the circumferential surface of the barrel, but does not necessarily extend entirely through the barrel.

In the illustrated case, the axial bore extends to and through the terminus 25 of the accessory receiving end 14, although alternative formation would not result in a deviation from the invention. A second, transverse bore 27 is formed in the end 14, appropriately spaced from the terminus 25. This transverse bore is positioned to match the location of a retainer aperture 30 formed in an accessory A, such as a socket. The position of the bore 27 and aperture 30 conforms to industry standards so that accessories from any of several industry sources may be used interchangeably and without adjustment.

Ensconced within the framework of bores 21, 23 and 27 is a quick disconnect system constructed in accordance with the present invention and capable of achieving the goals and objectives thereof. More particularly, a rod 32 is disposed in the axial bore 21 where it is retained while permitting limited axial movement therein. A retainer 34 is threaded, or otherwise fitted, into the bore 21 at the otherwise open end thereof in the terminus 25. A spring 36 is disposed between the retainer 34 and the rod 32 so as to normally bias the rod 32 away from the retainer toward the right as seen in FIGS. 3, 4, and 5.

A release pin 38 is reciprocally received in the transverse bore 23. The release pin is formed with a notch 41, which notch includes a surface defining a ramp 43. The end 45, of the rod 32, in contact with the release pin is received in the notch 41 and is beveled as at 47 at an angle which is substantially the same as the angle of the ramp 43. Accordingly, the end 45 is slidable along the face of the ramp as the release pin 38 is reciprocated to move the rod.

A spring 50 is provided in the bore to normally bias the release pin outwardly from the axis of the rod 32, although it has been shown that the release pin may be operable without the spring.

The remaining structure of the quick release mechanism includes a latch 52, which may be in the form of a ball or a pin or a combination thereof, although it is shown here as a pin with a rounded upper end. The rod 32 is formed with a notch 54 (see also FIG. 2) normally disposed in the plane of the latch, and the end of the latch is beveled as at 56. The beveled end 56 engages and rides upon a ramp 58, which is at the same angular relationship to thereby move the latch into, and permit movement out of, engagement with the accessory.

In order to secure the latch 52 from inadvertent separation from the system, such as by centrifugal force, a roll pin 61 is inserted in the accessory end 14 positioned to engage a flat 63 formed on the circumferential surface of the latch, causing a land 65 to be created, which prevents loss of the latch in the transverse bore, while permitting an appropriate amount to stick out beyond the outer surface of the accessory end. That protruding portion is intended to engage an accessory A until intentionally released.

In contradistinction, the release pin is not, in accordance with the invention, permitted to extend above the circumferential surface 67 of the barrel 12. In order, in keeping with the invention, to permit digital engagement of the pin to effect release of an accessory A, the open end of the transverse bore 23 is champhered, or countersunk, as at 69. Accordingly, and by virtue of the ramping contact between surfaces 43 and 47, neither centrifugal force, nor the length of the pin, are sufficient to cause the pin to appear above the surface of the barrel where it could cause damage or injury as the anvil is rotated by the tool T.

In operation, it will now be appreciated that, with the release pin 38 depressed, an accessory may be pushed on to the accessory end 14, the latch recedes into the transverse bore 27 until the latch is aligned with the retainer aperture 30 in the accessory. As the latch recedes into the bore 27 the rod 32 is urged to the right as seen in FIGS. 3, 4 and 5, which coincidently permits the release pin 38 to likewise recede into the bore 23.

Upon alignment of the latch with the aperture 30 in the accessory, the release pin 38 is release coincidently with relief of the downward pressure on the latch, and the bias created by the spring 36 urges the rod to the right, and the latch pin is ramped upwardly and into the aperture 30. Further movement of the rod to the right by the spring bias moves the latch out of the notch and onto the circumferential surface of the rod where it secures the accessory to the tool T.

In order to release the accessory A, the user digitally depresses the release pin 38. The immediate result is that the rod 32 is forced to the left as seen in FIGS. 3, 4 and 5 against the spring bias, and the latch drops down into the notch 54, thus freeing up the accessory, which is readily removed.

It will be noted in FIG. 5 that the aperture 72 in the accessory passes all the way through the wall of the accessory A, permitting use of a longer latch pin and a better engaging relationship between tool and accessory.

Having now described a preferred embodiment of the present invention, it will be appreciated by those skilled in the art that minor variations in the structure are within the contemplation of the invention and would not constitute a departure therefrom, which is described in the accompanying claims, wherein.

What is claimed is:

1. In a powered impact tool having an anvil, and being adapted to drive an accessory such as a socket to perform work, a quick release mechanism for selectively securing and releasing the accessory from the tool comprising:

an axial bore formed in said anvil; a rod in said bore, said rod being secured for limited movement in said bore;

a transverse bore, said transverse bore intersecting said axial bore;

a release pin, said release pin disposed in said transverse bore, and engaging said rod, said release pin being wholly within said anvil;

a latch, said latch engaging said rod and being movable by said rod between a latched and unlatched position, said latch adapted to retain an accessory on said anvil in its latched position;

a first spring, said first spring being disposed on said axial bore to normally bias said rod toward said release pin, whereby depression of said release pin moves said rod against the bias of said spring to permit said latch to move to said unlatched position, and release of said release pin causing said rod to be moved by said spring bias to lock said latch in its latched position.

2. The powered impact tool of claim 1, wherein said transverse bore is countersunk such that the top most portion of said release pin is digitally accessible while always below the circumference of said anvil.

3. The powered impact tool of claim 1 wherein an end of said rod is operatively engaged with said release pin, said end being beveled;

a ramp formed in said release pin, said ramp engaging said beveled end of said rod such that the surface of said beveled end rides on said ramp.

* * * * *